United States Patent [19]

Chronic

[11] 3,957,207

[45] May 18, 1976

[54] GIMBALL NOZZLE-TRIM

[76] Inventor: Bill M. Chronic, 707 N. 27th St., Boise, Idaho 83702

[22] Filed: Aug. 5, 1974

[21] Appl. No.: 492,554

[52] U.S. Cl. ..... 239/265.35; 60/232; 115/12 R

[51] Int. Cl.[2] ..... B63H 11/00

[58] Field of Search ..... 239/265.35, 265.33, 239/265.19; 115/12 R; 60/232

[56] References Cited

UNITED STATES PATENTS

| | | | |
|---|---|---|---|
| 3,003,312 | 10/1961 | Jewell | 239/265.35 |
| 3,046,736 | 7/1962 | Thomson | 60/232 |
| 3,048,010 | 8/1962 | Ledwith | 239/265.35 |
| 3,058,449 | 10/1962 | Corbett | 60/232 X |
| 3,237,890 | 3/1966 | Thielman | 239/265.35 X |
| 3,266,733 | 8/1966 | Goehler | 239/265.35 X |
| 3,776,173 | 12/1973 | Horwitz | 115/12 R |

*Primary Examiner*—Lloyd L. King
*Assistant Examiner*—Michael Mar
*Attorney, Agent, or Firm*—John W. Kraft; Charles L. Kraft, II

[57] ABSTRACT

The gimbal ring nozzle-trim comprises a substantially cylindrical forward control housing mounted to the discharge portion of a marine propulsion device, and having a frustra-orbicularly configured gasket-race flange at its rearwardmost terminal end; an annular gimbal ring mounted to the exterior cylindrical walls of the housing by pins disposed along the horizontal plane cutting the ring and housing distally forward of the gasket-race flange; and a nozzle having a hollow semi-orbicular portion which overrides the gasket-race flange and a substantially cylindrical portion issuing rearwardly from the orbicular portion of the nozzle, the nozzle being mounted by the forward interior surfaces of the orbicular portion to the exterior circumferential face of the gimbal ring by pins disposed through the nozzle into the gimbal ring along the vertical plane cutting the nozzle and gimbal ring.

5 Claims, 5 Drawing Figures

GIMBALL NOZZLE-TRIM

FIELD OF INVENTION

The present invention relates to marine jet propulsion apparatus and more particularly to a gimbal ring nozzle-trim for controlling the direction of thrust discharged by a marine jet propulsion apparatus.

BACKGROUND OF INVENTION

It is common that loading, or variations in loads, may shift the center of gravity of the vessel, and thus make it angle in the water. In vessels powered by inboard marine jet propulsion apparatus, the line of thrust is directed downwardly into the water rather than to a line parallelly below the surface of the water. This results in a loss of propulsive efficiency.

Accordingly, it is a primary object of this invention to provide means for selectively adjusting the nozzle portion of a marine jet propulsion discharge to an optimal line of thrust generally parallel below the surface of the water.

It is another object of this invention to provide aforesaid means for adjusting the line of thrust in a structure which is inherently simple and mechanically reliable.

It is a further object of this invention that the aforesaid means carry an improved steerable nozzle and means for controlling said nozzle.

It is another primary object of this invention to provide the nozzle and trim apparatus with a thrust reverse gate.

These and other objects shall become apparent from the description following, it being understood that modifications may be made without affecting the teachings of the invention here set out.

SUMMARY OF INVENTION

The gimbal ring nozzle-trim comprises a subatantially cylindrical forward control housing mounted to the discharge portion of a marine propulsion device, and having a frustra-orbicularly configured gasket-race flange at its rearwardmost terminal end; an annular gimbal ring mounted to the exterior cylindrical walls of the housing by pins disposed along the horizontal plane cutting the ring and housing distally forward of the gasket-race flange; and a nozzle having a hollow semi-orbicular portion which overrides the gasket-race flange and a substantially cylindrical portion issuing rearwardly from the orbicular portion of the nozzle, the nozzle being mounted by the forward interior surfaces of the orbicular portion to the exterior circumferential face of the gimbal ring by pins disposed through thy nozzle into the gimbal ring along the vertical plane cutting the nozzle and gimbal ring. The gimbal nozzle-trim may be provided with a thrust reversing gate mounted to the cylindrical portion of the nozzle 16.

A more thorough and comprehensive understanding may be had from the detailed description of the preferred embodiment when read in connection with the drawings forming a part of this specification.

DETAILED DESCRIPTION OF THE PREFERRED EMBODIMENT

Figure 1:
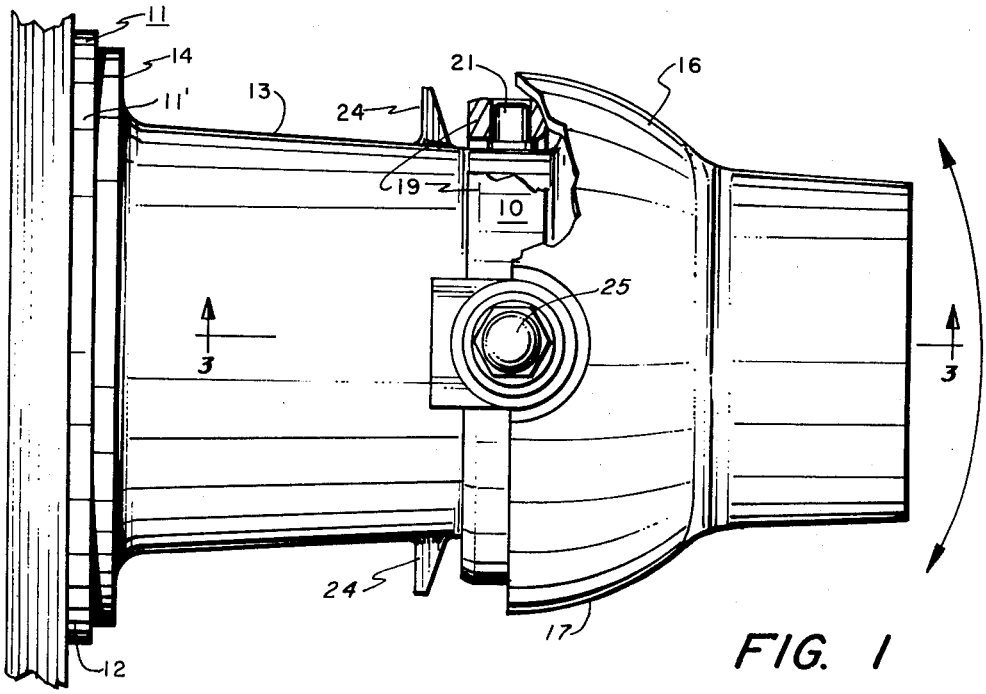
FIG. 1 is a fragmentary top plan view of the gimbal ring nozzle-trim of this invention.
Figure 2:
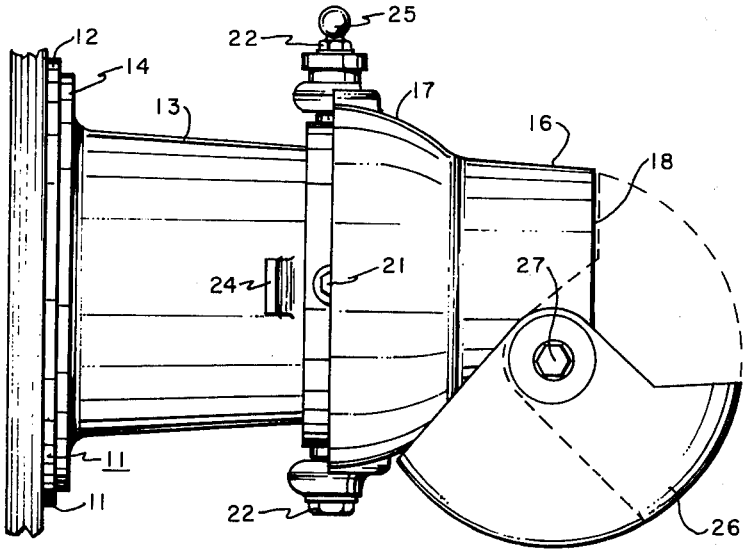
FIG. 2 is a side elevational view of the apparatus of FIG. 1 shown with the reversing assembly attached in broken lines showing its reversing position to advantage for illustrative purposes only.
Figure 3:
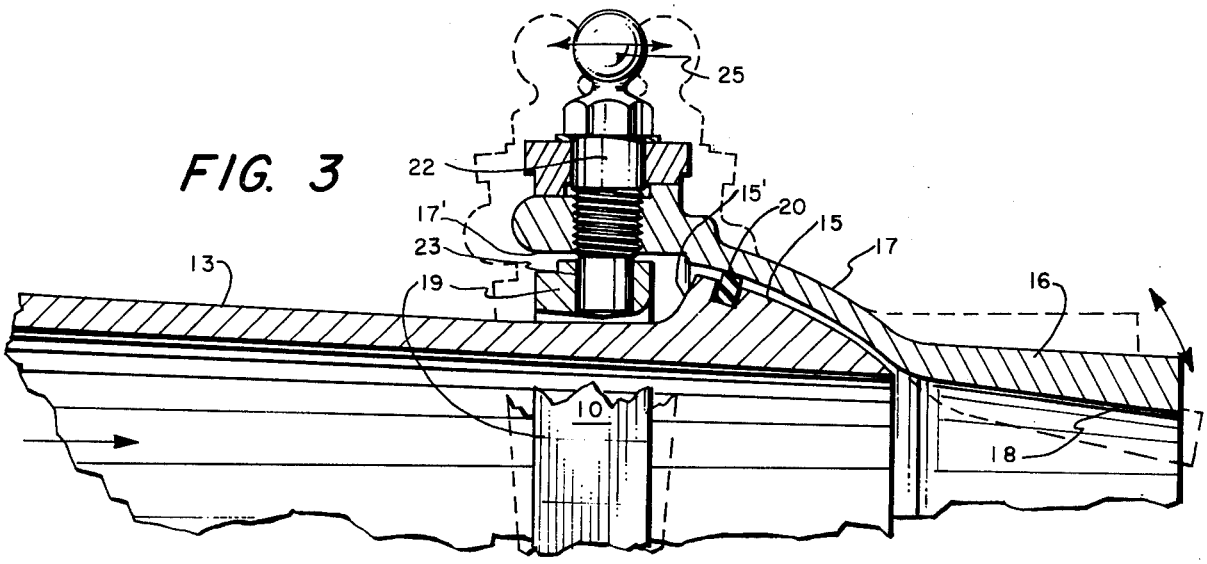
FIG. 3 is a fragmentary cross-sectional view taken along the lines 3—3 of the FIG. 1 showing the interior configuration thereof.
Figure 4:
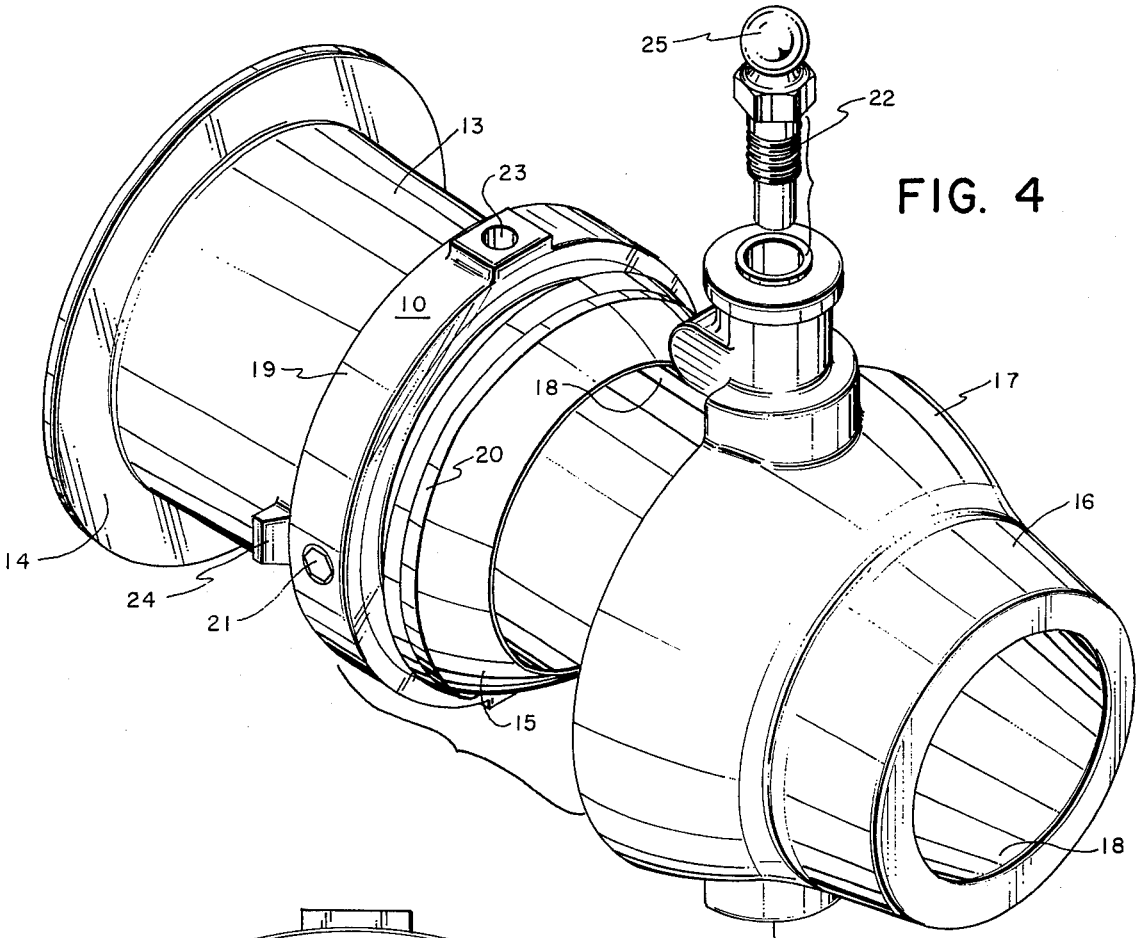
FIG. 4 is a rear perspective, partially exploded view of the gimbal ring nozzle-trim.

Referring now to the drawings, more particularly to the FIGS. 1 and 2, the gimbal ring nozzle-trim of this invention is shown to advantage and generally identified by the numeral 10. The gimbal nozzle-trim 10 is intended to be used in combination with any of a variety of inboard jet propulsion devices. The trim 10 may also be used with jet propulsion apparatus of the types disclosed in my application Ser. No. 376,259, filed July 3, 1973 now U.S. Pat. No. 3,885,120. More particularly, the trim 10 is mounted at and in alignment with the discharge orifice 12 of the device 11 which may have a flange 11' as shown in FIGS. 3 and 4. The trim 10 includes a forward control housing 13 which is the generally cylindrical duct having a flange 14 by which the housing 13 is mounted to the discharge orifice 12. The interior walls of the forward control housing 13 are substantially cylindrical and taper slightly front to rear. The rear portion of the exterior walls of the control housing 13 has a raised gasket-race flange 15 presenting a frustra-orbicular contour which is cut by the rearmost terminal end of the housing 13 and by a face at its forwardmost terminal end converging into the exterior cylindrical walls of the housing 13. An articulating nozzle 16 is mounted in the manner, hereinafter described, to overrun the rearward portion of the control housing 13. The nozzle 16 includes a hollow semi-orbicular portion 17 which overrides with a tolerance over the flange 15, and a cylindrical, slightly tapered exitway 18 having its larger forward inside diameter substantially the same as the inside diameter of the rearwardmost terminal end of the housing 13. As shall become apparent, the flange 15 provides a nominal race for the nozzle 16, and a watertight seal between the housing 13 and the nozzle 16. It may be seen that auxiliary seals 20 may be disposed in the flange 15 to supplement the latter object.

The means mounting the nozzle 16 to the housing 13 is a gimbal ring 19. The gimbal ring 19 is operable to permit upwardly and downwardly pivoting of the nozzle 16 over a limited arch in accordance with primary objects of this invention and to permit a fuller predetermined arch laterally along the horizontal axis for steering and like the former, nozzle pitch object is accomplished by mounting the annularly configured gimbal ring 19 about the exterior cylindrical walls of the housing 13 distally forward of the forward face of the flange 15 by pins 21 mounted through the horizontal plane cutting the ring 19 and housing 13. The interior circumferential face of the ring 19, which contacts the exterior cylindrical wall of the housing 13, may be machine/ with annularly inclined edges to facilitate rocking of the gimbal ring 19 off the pins 21. It may be seen that the forward face of the flange 15 provides an angularly disposed stop 15' or a restrictor to downward articulation of the rearwardmost terminal end of the nozzle 16. Similarly, the forward machined portion of the interior circumferential face of the ring 19 provides a restraint to upward articulation of the rearwardmost terminal end of the nozzle 16. In this way the gimbal ring 19 is operable to pivot through a predetermined arc to control pitch.

The manner of steering is accomplished by mounting the forward opening of the nozzle portion 17 over the exterior circumferential face of the gimbal ring 19. The interior face of the hollow portion 17 may be machined as a seat 17' for mounting the nozzle 16 to the ring 19. The means for mounting the nozzle 16 to the ring 19 includes vertically disposed pivot pins 22 which are threadably engaged through the portions 17', and which have smooth shafts provided on their centrally disposed terminal ends for engaging holes 23 disposed parallelly at opposing radians in the ring 19 along the vertical plane cutting the nozzle 16 and ring 19; i.e., at points perpendicular to the axis of the pivot pin 21. As above, with pitch control, pivoting of the nozzle 16 with respect to the housing 13 and the ring 19 may be controlled by suitable steering stops 24 which may be disposed parallelly and centrally on the exterior cylindrical walls of the housing 13.

Figure 5:
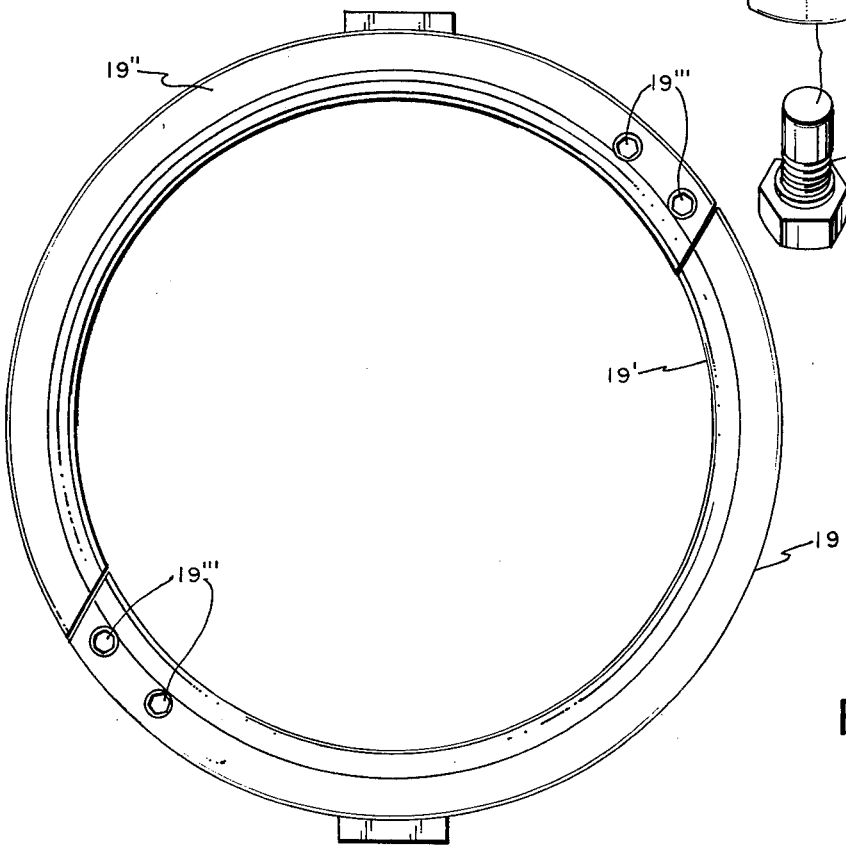
FIG. 5 is a plan view of the split-ring construction of the gimbal ring.

As shown in the FIG. 5, the gimbal ring 19 may be fabricated as a split-ring construction of semi-circular components 19' and 19'' fastened by conventional split-ring means 19'''. It is to be understood that the holes receiving the pins 21 and 22 may be machines to provide a substantially frictionless interface or may be provided with frictionless bushings or bearings (not shown) according to requirements of load and friction in the particular application of this invention.

Referring again to the FIGS. 3 and 4, forward and rearward pivoting of the ring 19 with respect to the housing 13, and horizontal pivoting of the nozzle 16 with respect to the ring 19, and housing 13 may each be selectively controlled by means of a steering capston 25 which is a portion of the pins 22. Any one of a commonly known prime movers such as hydraulic cylinders, levers, and the like may be attached to the capston 25 to pivot the ring 19 on the pins 21. Steering cables (not shown) or other steering actuators may be mounted to the capston 25 in the manner of commonly known rudder pivots and the like. In operation, a vessel may be loaded with cargo or persons which accordingly changes the center of gravity and, thus, the displacement of the vessel in the water. The actuator controlling the pitch may be actuated to move the pivot ring 19 and the nozzle 16 on the pins 21 to change the upward and downward line of thrust discharged by the jet propulsion device 11. The nozzle 16 may be articulated with respect to the housing 13 in the manner of commonly knwon durable marine jet propulsion devices. Hence, the attitude and the change in the center of gravity of the vessel may be selectively controlled or trimmed.

As shown in the FIG. 2, the nozzle 16 may be provided with a selectively controlled reverse gate 26. The gate 26 has a somewhat orbicular interior and exterior configuration wherein the gate 26 covers somewhat less than a hemisphere. The gate 26 pivots along the horizontal axis on a pin 27 disposed through the vertex of the frustra-orbicular gate 26 to a point in the lower portion in the rearward end of the nozzle portion 18. The upper edge of the gate 26 is comparable to mate with the upper end face of the nozzle portion 18. It may be seen that the gate 26 is of such size and configuration that a duct or passage is formed by the lower edge of the gate 26 extending over the bottom arcuate portion of the end of the nozzle portion 18. In the closed position, shown in phantom lines, the flow of water under pressure from the jet propulsion device 11 is diverted by the gate 26 through the passage between the lower portion of the gate 26 and the lower end surfaces of the nozzle portion 18, and around the lower outer walls of the nozzle 16 following the cylindrical walls of the portion 18 and curved walls of the portion 17. It may be seen that the general orbicular shape of the reverse gate 26 may be modified from a smooth curvature to variations ranging to polynomial and other designs. The lower, passage portion of the gate 26 with a wall (not shown) disposed parallelly to the curved wall of the gate 26 to form a conduit for passage to better direct fluid under pressure. The gate 26 may be actuated by any of the variety of linkages, cable relations and the like.

It is to be understood that the vessel may be trimmed, as set above, in either of two operating directions, namely forward or rearward thrusting operation.

Having thus described in detail a preferred apparatus which embodies the concepts and principles of the invention and which accomplishes the various objects, purposes and aims thereof, it is to be appreciated and will be apparent to those skilled in the art that many physical changes could be made in the apparatus without altering the inventive concepts and principles embodied therein. Hence, it is intended that the scope of the invention be limited only to the extent indicated in the appended claims.

I claim:

1. A gimbal ring nozzle-trim, comprising:

a substantially cylindrical forward-control housing mounted at and in alignment with the discharge orifice of a marine jet propulsion apparatus, said control housing having a frustral-orbicularly configured gasket-race flange projecting from the exterior cylindrical walls rearward most terminal end of the exterior cylindrical walls;

an annular gimbal ring mounted to the exterior cylindrical walls of the housing by pins disposed along the horizontal plane cutting said trim and said housing distally forward of said gasket-race flange; and a nozzle having a hollow semi-orbicular portion which overrides said gasket-race flange, having a substantial portion issuing rearwardly from said orbicular portion to the exterior circumferential face of said gimbal ring by pins disposed through the nozzle in the gimbal ring along the plane cutting said housing and said gimbal ring, the apparatus of claim 1 wherein, the interior circumferential edge of said gimbal ring is machined into a forward angularly disposed face and a rear angularly disposed face providing means for permitting pivot of said ring with respect to said housing and for restricting the arc of pivot of said gimbal ring with respect to said housing.

2. The apparatus of claim 1 wherein said cylindrical portion of said nozzle is slightly tapered down from front to rear and has substantially the same interior diameter at its forward portion as the interior diameter of the rearwardmost terminal end of said housing.

3. The apparatus of claim 2 wherein the interior walls of said housing are slightly tapered down from front to rear.

4. The apparatus of claim 1 including a thrust reverse gate mounted to the rearward portion of said cylindrical portion of said nozzle.

5. The apparatus of claim 4 wherein said reverse gate is a frustra-orbicular configuration covering less than a hemispheric proportion pivotally mounted at its vertex to the lower rearward portion of said cylindrical nozzle portion, and wherein said reverse gate mates with the upper articulate portion of rearwardmost portion end of said nozzle and is larger than said nozzle, providing a downwardly pivoted passageway at the lower portion of said nozzle.

* * * * *